US007635669B2

(12) United States Patent
Culley

(10) Patent No.: US 7,635,669 B2
(45) Date of Patent: Dec. 22, 2009

(54) COMPOSITIONS COMPRISING AT LEAST ONE HYDROXY-SUBSTITUTED CARBOXYLIC ACID

(75) Inventor: Scott Anthony Culley, Midlothian, VA (US)

(73) Assignee: Afton Chemical Corportation, Richmond, VA (US)

( * ) Notice: Subject to any disclaimer, the term of this patent is extended or adjusted under 35 U.S.C. 154(b) by 801 days.

(21) Appl. No.: 10/957,992

(22) Filed: Oct. 4, 2004

(65) Prior Publication Data

US 2006/0073993 A1 Apr. 6, 2006

(51) Int. Cl.
*C10M 169/00* (2006.01)
*C10M 169/04* (2006.01)
*C09K 15/08* (2006.01)

(52) U.S. Cl. ..... 508/519; 508/516; 508/517; 508/518; 508/520; 508/521; 508/522; 508/523; 252/76; 252/79

(58) Field of Classification Search ..... None
See application file for complete search history.

(56) References Cited

U.S. PATENT DOCUMENTS

| | | | | |
|---|---|---|---|---|
| 2,632,695 | A | 3/1953 | Landis et al. | |
| 4,569,776 | A | 2/1986 | Miller et al. | |
| 4,956,110 | A | 9/1990 | Lenack et al. | |
| 5,681,506 | A | 10/1997 | Pragnell et al. | |
| 5,688,751 | A | 11/1997 | Cleveland et al. | |
| 6,001,141 | A | 12/1999 | Quigley | |
| 6,008,169 | A * | 12/1999 | Kaneko | 508/501 |
| 6,534,581 | B1 * | 3/2003 | Kleyer et al. | 524/379 |
| 6,746,778 | B1 | 6/2004 | Negele et al. | |
| 6,748,905 | B2 | 6/2004 | Duncan et al. | |
| 6,750,183 | B2 | 6/2004 | Gutierrez et al. | |
| 2002/0193263 | A1 * | 12/2002 | Yoneta et al. | 508/517 |
| 2003/0013623 | A1 * | 1/2003 | Tse et al. | 508/591 |
| 2004/0104377 | A1 * | 6/2004 | Phelps et al. | 252/387 |
| 2004/0129603 | A1 * | 7/2004 | Fyfe et al. | 208/18 |

FOREIGN PATENT DOCUMENTS

| | | |
|---|---|---|
| WO | 01/08652 | 2/2001 |

* cited by examiner

*Primary Examiner*—Glenn A Caldarola
*Assistant Examiner*—Vishal Vasisth

(57) ABSTRACT

There is provided a fluid composition including at least one hydroxy-substituted carboxylic acid. Also provided are methods of inhibiting at least one of corrosion and rust and of improving at least one of lubricity and lead compatibility. Also provided are lubricating, fuel, anticorrosion, antirust, and additive concentration compositions.

21 Claims, No Drawings

COMPOSITIONS COMPRISING AT LEAST ONE HYDROXY-SUBSTITUTED CARBOXYLIC ACID

FIELD OF THE INVENTION

The present disclosure relates to a fluid composition comprising at least one hydroxy-substituted carboxylic acid. The at least one hydroxy-substituted carboxylic acid provides at least one property chosen from rust inhibition, corrosion inhibition, improved lubricity, and improved lead compatibility. The transmission fluid composition disclosed herein includes fluids that may be suitable for use in an automatic transmission, continuous variable transmission, and/or a manual transmission.

BACKGROUND OF THE INVENTION

Extremely high metal-on-metal pressures are present in newer automatic and manual transmissions such as step automatic transmissions, continuously variable transmissions, and manual or automated manual transmissions. High pressures are also present in various gear drive components such as automotive differentials and power transmission gear drive components.

In this regard, it is widely known that lubrication has a profound effect in reducing wear associated with automotive machinery, such as engines, transmissions, and other equipment having moving parts. Lubrication separates the moving surfaces with a film which can be sheared with low resistance, without causing damage to the surfaces.

Carboxylic acids, such as caprylic acid, are useful as corrosion inhibitors and lubricity improvers in lubricants and fuels. Unfortunately, caprylic acid causes corrosion in machine, engine, and transmission parts that contain lead as part of the material of construction.

U.S. Pat. No. 6,750,183, is directed to crankcase lubricating oils comprising a major amount by weight of an oil of lubricating viscosity; a minor amount by weight of a high molecular weight, nitrogen-containing dispersant; and an amount of an oil soluble, or oil dispersible aromatic hydrocarbyl oligomer sufficient to provide the lubricating composition with improved soot dispersing properties, wherein the dispersant may be made from monounsaturated carboxylic acids.

U.S. Pat. No. 6,748,905, is directed to a process for reducing engine wear in the operation of an internal combustion engine, comprising: (A) recirculating at least part of the exhaust gas from the engine to the intake air supply of the engine; and (B) operating the engine using a water-blended fuel composition made by combining: (i) a normally liquid hydrocarbon fuel; (ii) water; and (iii) at least one surfactant. The surfactant may be one or more acylating agents, such as a carboxylic acid reacted with, for example, an amine.

U.S. Pat. No. 6,746,778, is directed to a metal substrate with a corrosion-proofing bond coating containing adhesion-conferring polymers, based on organic compounds, such as cinnamic acid.

U.S. Pat. No. 6,001,141, is directed to low sulfur content fuel compositions containing additive compounds which exhibit improved lubricity. The additive compounds include a carboxylic acid substituted by at least one hydroxyl group, and derivatives of the carboxylic acid substituted by at least one hydroxyl group.

SUMMARY OF THE INVENTION

According to various embodiments, there is provided a transmission fluid composition comprising at least one hydroxy-substituted carboxylic acid.

According to various embodiments, there is provided a lubricant composition comprising at least one hydroxy-substituted carboxylic acid.

According to various embodiments, there is provided a fuel composition comprising (a) a fuel in a major amount; and (b) a fluid composition comprising at least one hydroxy-substituted carboxylic acid in a minor amount.

According to various embodiments, there is provided a method for inhibiting corrosion of machinery comprising providing a fluid composition comprising at least one hydroxy-substituted carboxylic acid to machinery.

According to various embodiments, there is provided a method for inhibiting rust of machinery, comprising providing a fluid composition comprising at least one hydroxy-substituted carboxylic acid to machinery.

According to various embodiments, there is provided a lubricating oil composition comprising a major amount of an oil and a minor amount of a composition comprising at least one hydroxy-substituted carboxylic acid.

According to various embodiments, there is provided an antirust composition comprising at least one hydroxy-substituted carboxylic acid.

According to various embodiments, there is provided an anticorrosion composition comprising at least one hydroxy-substituted carboxylic acid.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DESCRIPTION OF THE INVENTION

In accordance with the present disclosure, there is provided a transmission fluid composition comprising at least one hydroxy-substituted carboxylic acid.

The fluid composition includes, but is not limited to, fluid compositions such as those suitable for use as an automatic transmission fluid (ATF), continuous variable transmission fluid, manual transmission fluid, and a fluid used in dual clutch transmissions. The at least one hydroxy-substituted carboxylic acid may also be used in other fluid compositions, such as gear lubricants and fuels.

The at least one hydroxy-substituted carboxylic acid may be present in the fluid composition in an amount sufficient to inhibit at least one of rust and corrosion and/or to improve lubricity. For example, the at least one hydroxy-substituted carboxylic acid may be present in the composition in an amount ranging from about 0.05% to about 0.2% by weight, as a further example from about 0.01 to about 0.5% by weight, relative to the total weight of the composition.

The at least one hydroxy-substituted carboxylic acid may typically contain up to 60 carbon atoms and may be a mono- or poly-carboxylic acid or a dimerized acid. The carbon chain of the carboxylic acid may be at least one of saturated or unsaturated, branched or linear, and cyclic, including polycyclic or acyclic. The carboxylic acid may be aliphatic, cycloaliphatic, aromatic, or heterocyclic in character.

When mono-carboxylic acids are used they may typically contain 8 to 40 carbon atoms, such as 10 to 30, and for example 12 to 24 carbon atoms. Examples include, but are not limited to, aliphatic carboxylic acids such as lauric acid, myristic acid, heptadecanoic acid, palmitic acid, stearic acid, oleic acid, linoleic acid, linolenic acid, nonadecanoic acid, arachic acid, behenic acid, caprylic acid, pelargonic acid, capric acid, margaric acid, isostearic acid, arachidic acid, behenic acid, lignoceric acid, cerotic acid, montanic acid, melissic acid, caproleic acid, palmitoleic acid, eraidic acid, fatty acid of coconut oil, fatty acid of hardened fish oil, fatty acid of hardened rapeseed oil, fatty acid of hardened tallow oil, fatty acid of hardened palm oil, dodecenyl succinic acid and its anhydride, and decanoic acid. The term "aliphatic" as used herein may be understood to mean acyclic or cyclic, saturated or unsaturated carbon compounds, excluding aromatic compounds.

Examples of an aliphatic saturated carboxylic acid include, but are not limited to, linear saturated acids such as caproic acid, caprylic acid, capric acid, lauric acid, myristic acid, palmitic acid, stearic acid, arachic acid, cerotic acid, and laccelic acid. Examples of aliphatic saturated carboxylic acids include, but are not limited to, branched carboxylic acids such as isopentanoic acid, 2-methylpentanoic acid, 2-methylbutanoic acid, 2,2-dimethylbutanoic acid, 2-methylhexanoic acid, 5-methylhexanoic acid, 2,2-dimethyl-heptanoic acid, 2-ethyl-2-methylbutanoic acid, 2-ethylhexanoic acid, dimethylhexanoic acid, 2-n-propylpentanoic acid, 3,5,5-trimethylhexanoic acid, dimethyloctanoic acid, isotridecanoic acid, isomyristic acid, isostearic acid, isoarachic acid, and isohexanoic acid. Examples of unsaturated carboxylic acids include, but are not limited to, palmitoleic acid, oleic acid, elaidic acid, linoleic acid, and linoleic acid, and ricinolic acid. Alicyclic carboxylic acids such as naphthenic acid can also be used. The carboxylic acids may be used in combination of two or more.

Examples of aromatic carboxylic acids include, but are not limited to, benzoic acid, phthalic acid, trimellitic acid, and pyromellitic acid.

When poly-carboxylic acids are used, such as di- or tri-carboxylic acids, they may typically contain 3 to 40 carbon atoms, such as 3 to 30, and for example from 3 to 24 carbon atoms. Examples include, but are not limited to, dicarboxylic acids such as succinic, malic, tartaric, adipic, glutaric, suberic, azelaic and sebacic acids, and tricarboxylic acids such as 1,3,5-cyclohexane tricarboxylic acid and tetracarboxylic acids such as 1,2,3,4-butane tetracarboxylic acid.

It is also possible to use hydroxy-substituted dimerized acids. Herein such compounds may be referred to as dimer and trimer acids. When used, the dimerized acid may typically contain from about 10 to about 60, for example from about 20 to about 60 and as a further example from about 30 to about 60, carbon atoms. Such acids may be prepared by dimerizing unsaturated acids and typically comprise a mixture of the monomer, dimer and trimer of the acid. The dimer may exist as a mixture of 2% by weight monomer, 83% by weight dimer and 15% by weight of trimer and possibly higher acids. This dimerized acid, as well as the other acids described above, are commercially available or may be prepared by the application or adaption of known techniques.

Any of the carboxylic acids may be modified to include a hydroxy functional group. Such a modification would be known to those of ordinary skill in the art. The at least one hydroxy-substituted carboxylic acid may comprise at least one hydroxyl functional group. Moreover, the at least one hydroxy-substituted carboxylic acid may comprise at least one carboxylic acid functional group.

Examples of the at least one hydroxy-substituted carboxylic acid which may be used include, but are not limited to, ricinoleic acid, malic acid, tartaric acid, citric acid, 3-(4-hydroxyphenyl)propionic acid, 6-hydroxycaproic acid (6-hydroxyhexanoic acid), 2-hydroxycinnamic acid, and 3-(2-hydroxyphenyl)propionic acid.

The at least one hydroxy-substituted carboxylic acid may have a low melting point. Moreover, the at least one hydroxy-substituted carboxylic acid may be a liquid.

It is believed, without being limited to any particular theory, that a composition comprising the at least one hydroxy-substituted carboxylic acid may meet the standards for an oxidation test which measures the change in the total acid number. An example of an oxidation test is the MERCON® Aluminum Beaker Oxidation Test (ABOT), FMC BJ 10-4, revision 1, 2003. Using this test a composition comprising the at least one hydroxy-substituted carboxylic acid may have a change in the total acid number of less than or equal to 5. The MERCON V® Aluminum Beaker Oxidation Test (ABOT) requires a composition to have a change in total acid number of less than 3.5. As a further example, the G.M. DEXRON®-III, H Revision, ATF GMN10055, oxidation test, October 2003, requires a composition to have a change in total acid number less than 3.25, and the cycling test requires a composition to have a change in total acid number of less than 2.0.

The at least one hydroxy-substituted carboxylic acids may also pass a lead coupon test. As part of the oxidation tests, a lead coupon may be placed in a beaker with the fluid composition containing the at least one hydroxy-substituted carboxylic acid. The lead coupon may then be evaluated based upon its appearance and based on its weight. For example, at the end of the test the lead coupon which has been submerged in a composition comprising the at least one-hydroxy-substituted carboxylic acid may not possess corrosion, such as in the form of deposits on the lead coupon.

Moreover, the weight of the lead coupon may be evaluated by weighing the lead coupon before and after the test. For an accurate measurement at the conclusion of the test, the lead coupon should be wiped to remove any corrosive deposits before it is weighed. A lead coupon exposed to a composition of the present invention may possess a change in weight that is limited to 3% before and after wiping.

The at least one hydroxy-substituted carboxylic acid may also be added to at least one additive in the appropriate proportions thereby providing a multifunctional fuel additive package. Examples of at least one additive which may be used include, but are not limited to, dispersants, detergents, antioxidants, carrier fluids, metal deactivators, dyes, markers, corrosion inhibitors, biocides, antistatic additives, drag-reducing agents, demulsifiers, dehazers, anti-icing additives, anti-knock additives, anti-valve-seat recession additives, lubricity additives, combustion improvers, cold flow improvers, friction modifiers, antiwear agents, antifoam agents, viscosity index improvers, antirust additives, seal swell agents, metal deactivators, and air expulsion additives.

In selecting at least one additive, it is important to ensure that the selected additive is/are soluble or stably dispersible in the fuel additive package and finished composition, are compatible with the other components of the composition, and do not interfere significantly with the performance properties of the composition, such as rust inhibition, corrosion inhibition, improved lubricity, and improved lead compatibility, needed or desired, as applicable, in the overall finished composition.

For the sake of convenience, the at least one additive may be provided as a concentrate for dilution. Such a concentrate forms part of the present invention and typically comprises from 99 to 1% by weight additive and from 1 to 99% by weight of solvent or diluent for the additive, which solvent or diluent may be miscible and/or capable of dissolving in the fuel in which the concentrate may be used. The solvent or diluent may, of course, be the low sulfur fuel itself. However, examples of other solvents or diluents include white spirit, kerosene, alcohols (e.g. 2-ethyl hexanol, isopropanol and isodecanol), high boiling point aromatic solvents (e.g. toluene and xylene) and cetane improvers (e.g. 2-ethyl hexylnitrate). Of course, these may be used alone or as mixtures.

In general, the at least one additive may be employed in minor amounts sufficient to improve the performance characteristics and properties of the base fluid. The amounts will thus vary in accordance with such factors as the viscosity characteristics of the base fluid employed, the viscosity characteristics desired in the finished fluid, the service conditions for which the finished fluid is intended, and the performance characteristics desired in the finished fluid.

It will be appreciated that the individual components employed can be separately blended into the base fluid or can be blended therein in various subcombinations, if desired. Ordinarily, the particular sequence of such blending steps may not be crucial. Moreover, such components can be blended in the form of separate solutions in a diluent. According to various embodiments, however, the additive components may be blended in the form of a concentrate, as this simplifies the blending operations, reduces the likelihood of blending errors, and takes advantage of the compatibility and solubility characteristics afforded by the overall concentrate.

The base fuels used in formulating the fuel compositions according to the present disclosure may include any base fuels suitable for use in the operation of spark-ignition internal combustion engines, such as leaded or unleaded motor and aviation gasolines; gas to liquid (GTL) fuel, such as gasoline fraction, kerosene fraction and light oil fraction; and so-called reformulated gasolines which typically contain both hydrocarbons of the gasoline boiling range and fuel-soluble oxygenated blending agents, such as alcohols, ethers and other suitable oxygen-containing organic compounds. Suitable oxygenates may include, for example, methanol, ethanol, isopropanol, t-butanol, mixed $C_1$ to $C_5$ alcohols, methyl tertiary butyl ether, tertiary amyl methyl ether, ethyl tertiary butyl ether, and mixed ethers. Oxygenates, when used, may normally be present in the base fuel in an amount below about 25% by volume, for example in an amount that provides an oxygen content in the overall fuel in the range of about 0.5 to about 5% by volume.

According to various embodiments, the transmission fluid composition may be used in the transmission of a vehicle, such as in a torque converter.

Moreover, the at least one hydroxy-substituted carboxylic acid may be used in a lubricant composition. The lubricant composition may be used to lubricate any machinery, including any machinery having lead parts, such as an at least one bushing in the transmission of a vehicle engine and any gears in a vehicle.

According to various embodiments, there is a fuel composition comprising (a) a fuel in a major amount; and (b) a fluid composition comprising at least one hydroxy-substituted carboxylic acid in a minor amount. A "major amount" may be understood to mean greater than or equal to 50%. A "minor amount" may be understood to mean less than 50%.

EXAMPLES

Example 1

Corrosion Test for Lubricants

The component to be tested was weighted to the nearest milligram and charged into a 25 by 150-mm test tube. Typically the components were tested such that their concentration in finished lubricant was 0.05 to 0.2% by weight. 20.0 g of a typical automatic transmission fluid was charged into the test tube. A lead coupon 0.81 cm thick by 2.5 cm square was bent into a semi-circle and inserted into the tube. The tube was placed in an oil bath at 150° C. for 14-42 hr. Upon completion of the test the lead coupon was removed from the fluid and washed with heptane and air dried. The appearance of the coupon and the end of test fluid was recorded. The coupon was washed with THF and wiped clean. The post cleaning weight of the coupon was recorded. The end of test fluid was analyzed for the presence of lead by Inductively Coupled Plasma Atomic Emission Spectroscopy (ICP).

As an alternative to charging the component to be tested, the component can be delivered to the finished oil via an additive concentrate. In this case 20.0 grams of the finished fluid was used.

The following results were obtained as show in Tables 1 and 2.

TABLE 1

| | 150° C. 42 hours | | | | | | | |
|---|---|---|---|---|---|---|---|---|
| | A | B | C | D | E | F | G | H |
| Comments | Baseline | hydrocinn | 4hydroxyph | hydroxcap | cinnamic | hydroxcin | 2hydroxypro | caprylic |
| concentration mg/20 g | None | 15.9 | 15.5 | 18.9 | 17.1 | 18.1 | 16.2 | 16.7 |
| concentration wt % | | 0.0795 | 0.0775 | 0.08127 | 0.0855 | 0.0905 | 0.081 | 0.0835 |
| EOT Fluid clarity | Clear | hazy | clear | Hazy | slt. Hazy | clear | clear | hazy |
| Lead in fuid (ppm) | 8 | 257 | 29 | 484 | 243 | 15 | 2 | 1720 |
| Pb coupon Condition | Clean | deposits | clean | deposits | deposits | clean | clean | black |
| bottom sediment | None | Hvy | None | Slight | hvy | none | very slt | heavy |

B = hydrocinnamic acid, (3-phenylpropionic acid)
C = 3-(4-hydroxyphenyl)propionic acid
D = 6-hydroxycaproic, (6-hydroxyhexanoic acid)
E = cinnamic acid
F = 2-hydroxycinnamic acid
G = 3-(2-hydroxyphenylpropionic acid
H = caprylic acid, (octanoic acid)

TABLE 2

| | 150° C. for 14 hrs | | | | | | | |
|---|---|---|---|---|---|---|---|---|
| | A | B | C | D | E | F | G | H |
| Comments | hydroxcin | hydroxycin | Cinnamic | cinnamic | hydroxycap | hydroxycap | hexanoic | hexanoic |
| acid wt (mg) | 26 | 27.4 | 26.3 | 23.6 | 31.1 | 28.6 | 21 | 22 |
| Concentration wt % | 0.13 | 0.14 | 0.13 | 0.12 | 0.13 | 0.12 | 0.11 | 0.11 |
| EOT Fluid clarity | clear | Clear | Hazy | hazy | hazy | hazy | hazy | hazy |
| Lead in fluid (ppm) | 10 | 25 | 624 | 693 | 655 | 628 | 1253 | 1253 |
| Pb coupon Condition | clean | Clean | black/deposits | black/deposits | black/deposits | Black/deposits | black/deposits | black/deposits |
| wt loss per surface area (mg/sq cm) | 0.10 | 0.50 | 3.02 | 2.44 | | | | |
| Sediment | none | None | Light | Light | moderate | moderate | heavy | heavy |

A and B used hydroxycinnamic acid.
C and D used cinnamic acid.
E and F used hydroxycaproic acid.
G and H used hexanoic acid.

Compositions comprising the at least one hydroxy-substituted carboxylic acid, such as 2-hydroxycinnamic acid, exhibited a clear fluid, little to no sediment, and exhibited an acceptable weight loss of the lead coupon at the end of the corrosion test.

Example 2

MERCON Aluminum Beaker Oxidation Test (ABOT), FMC BJ 10-4, Revision 1, -2003

A 300 hr ABOT test was run according to the specified procedures at 150° C. on finished automatic transmission fluids containing various carboxylic acids. The lead coupons were removed after 100 hours. The results are summarized in the table below:

| Acid | 100 hour weight loss | 300 hour delta TAN |
|---|---|---|
| | Fluid 1 | |
| None | 0.17% | 0.98 |
| Caprylic | 6.95% | −0.11 |
| Hydroxyphenylpropionic | 0.18% | 0.58 |
| Hydroxystearic | 4.95% | 0.49 |
| | Fluid 2 | |
| None | 2.4% | |
| 0.19% Cinnamic | 4.2% | |
| 0.1% Hydroxycinnamic | 0.2% | |
| 0.19% Hydroxycinnamic | 0.9% | |

Compositions comprising the at least one hydroxy-substituted carboxylic acid, such as hydroxyphenylpropionic acid exhibited an acceptable change in total acid number (delta TAN) and an acceptable weight loss of the lead coupon.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A transmission fluid composition comprising a transmission base fluid and at least one hydroxyl-substituted carboxylic acid selected from the group consisting of hydroxycinnamic acid, 3-(4-hydroxyphenyl)propionic acid, 2-hydroxycinnamic acid, and 3-(2-hydroxyphenyl)propionic acid.

2. The transmission fluid composition according to claim 1, wherein a transmission base fluid and the fluid composition comprises a fluid selected from the group consisting of automatic transmission fluids, continuous variable transmission fluids, manual transmission fluids, and fluids used in dual clutch transmissions.

3. The transmission fluid composition according to claim 1, wherein the at least one hydroxy-substituted carboxylic acid is present in the composition in an amount effective to inhibit rust.

4. The transmission fluid composition according to claim 1, wherein the at least one hydroxy-substituted carboxylic acid is present in the composition in an amount effective to inhibit corrosion.

5. The transmission fluid composition according to claim 1, wherein the at least one hydroxy-substituted carboxylic acid is present in the composition in an amount effective to improve lead compatibility.

6. The transmission fluid composition according to claim 1, wherein the at least one hydroxy-substituted carboxylic acid is present in the composition in an amount ranging from about 0.05% to about 0.2% by weight relative to the total weight of the composition.

7. The transmission fluid composition according to claim 6, wherein the at least one hydroxy-substituted carboxylic acid is present in the composition in an amount ranging from about 0.01% to about 0.5% by weight relative to the total weight of the composition.

8. The transmission fluid composition according to claim 1, further comprising at least one additive selected from the group consisting of dispersants, detergents, antioxidants, carrier fluids, metal deactivators, dyes, markers, corrosion inhibitors, biocides, antistatic additives, drag-reducing agents, demulsifiers, dehazers, anti-icing additives, anti-knock additives, anti-valve-seat recession additives, lubricity additives, combustion improvers, cold flow improvers, friction modifiers, antiwear agents, antifoam agents, viscosity index improvers, antirust additives, seal swell agents, metal deactivators, and air expulsion additives.

9. A vehicle comprising a transmission, the transmission including the transmission fluid composition according to claim 1.

10. A lubricant composition comprising a transmission base fluid and at least one hydroxy-substituted carboxylic acid selected from the group consisting of hydroxycinnamic acid, 3-(4-hydroxyphenyl)propionic acid, 2-hydroxycinnamic acid, and 3-(2-hydroxyphenyl)propionic acid.

11. A vehicle comprising at least one lead part and a lubricant composition according to claim 10.

12. A vehicle comprising at least one gear lubricated with the lubricant composition according to claim 10.

13. A method for inhibiting corrosion of machinery comprising providing a fluid composition comprising a transmission base fluid and at least one hydroxy-substituted carboxylic acid to machinery, wherein the at least one hydroxy-substituted carboxylic acid is selected from the group consisting of hydroxycinnamic acid, 3-(4-hydroxyphenyl) propionic acid, 2-hydroxycinnamic acid, and 3-(2-hydroxyphenyl)propionic acid.

14. The method according to claim 13, wherein the fluid composition is provided to an engine.

15. The method according to claim 13, wherein the fluid composition is provided in a transmission.

16. A method for inhibiting rust of machinery, comprising providing a fluid composition comprising a transmission base fluid and at least one hydroxy-substituted carboxylic acid to machinery, wherein the at least one hydroxy-substituted carboxylic acid is selected from the group consisting of hydroxycinnamic acid, 3-(4-hydroxyphenyl)propionic acid, 2-hydroxycinnamic acid, and 3-(2-hydroxyphenyl)propionic acid.

17. The method according to claim 16, wherein the fluid composition is provided to an engine.

18. The method according to claim 16, wherein the fluid composition is provided in a transmission.

19. A lubricating oil composition comprising a major amount of a transmission base fluid and oil and a minor amount of a composition comprising at least one hydroxy-substituted carboxylic acid selected from the group consisting of hydroxycinnamic acid, 3-(4-hydroxyphenyl)propionic acid, 2-hydroxycinnamic acid, and 3-(2-hydroxyphenyl)propionic acid.

20. An additive concentrate composition comprising a solvent or diluent, and at least one hydroxyl-substituted carboxylic acid selected from the group consisting of hydroxycinnamic acid, 3-(4-hydroxyphenyl)propionic acid, 2-hydroxycinnamic acid, and 3-(2-hydroxyphenyl)propionic acid.

21. The additive concentrate composition according to claim 20, further comprising at least one additive selected from the group consisting of dispersants, detergents, antioxidants, carrier fluids, metal deactivators, dyes, markers, corrosion inhibitors, biocides, antistatic additives, drag-reducing agents, demulsifiers, dehazers, anti-icing additives, anti-knock additives, anti-valve-seat recession additives, lubricity additives, combustion improvers, cold flow improvers, friction modifiers, antiwear agents, antifoarn agents, viscosity index improvers, antirust additives, seal swell agents, metal deactivators, and air expulsion additives.

* * * * *